US005566524A

United States Patent [19]

Bettin

[11] Patent Number: 5,566,524

[45] Date of Patent: Oct. 22, 1996

[54] COUPLING FOR COMPOUND PROFILE MEMBERS FOR DOORS OR WINDOWS

[75] Inventor: Giancarlo Bettin, Gonars, Italy

[73] Assignee: Archimede Progetti Srl, Gonars, Italy

[21] Appl. No.: 196,099

[22] PCT Filed: Apr. 29, 1992

[86] PCT No.: PCT/IT92/00048

§ 371 Date: Feb. 18, 1994

§ 102(e) Date: Feb. 18, 1994

[87] PCT Pub. No.: WO93/04256

PCT Pub. Date: Mar. 4, 1993

[30] Foreign Application Priority Data

Aug. 23, 1991 [IT] Italy ..... UD91A0133

[51] Int. Cl.[6] ..... E04C 2/38

[52] U.S. Cl. ..... 52/717.01; 52/718.04

[58] Field of Search ..... 52/717.01, 211, 52/718.02, 204.51; 49/404, 425, 204.53, 718.04, 718.06, 717.01

[56] References Cited

U.S. PATENT DOCUMENTS

| | | | |
|---|---|---|---|
| 2,274,730 | 3/1942 | Owen | 49/425 |
| 2,867,014 | 1/1959 | Fredricksen | 52/717.01 |
| 3,837,119 | 9/1974 | Lonneally et al. | 49/404 |
| 4,126,912 | 11/1978 | Johnson | 49/404 X |
| 4,639,970 | 2/1987 | Adams | 49/425 X |

FOREIGN PATENT DOCUMENTS

| | | | |
|---|---|---|---|
| 2219618 | 12/1989 | United Kingdom | 49/404 |
| 2226357 | 6/1990 | United Kingdom | 49/404 |

*Primary Examiner*—Carl D. Friedman
*Assistant Examiner*—Creighton Smith
*Attorney, Agent, or Firm*—Edmund M. Jaskiewicz

[57] ABSTRACT

Several keys (A) are spaced along the profile (C), having opposite flanges, which are connected to the profiles by rotation. There is a key-shaped flange on one side (1) and a disc-shaped flange on the other (4), connected by a neck (3) with an intermediate rotation key (2). Said disc-shaped flange (4), has a modified disc-shaped form with elastic interference protrusions (42) on two orthogonal axes (X/Y) respectively coinciding one or the other (X—X) with the plane passing on the longitudinal axis of said key-shaped flange (1). After having inserted the disc-shaped flange of the key (4) inside the same first profile (C) and having rotated it 45 degrees in respect to the interference axis in the first profile (Z1/Z2), said keys can scroll freely (A) inside the respective groove of the first profile (C).

5 Claims, 3 Drawing Sheets

COUPLING FOR COMPOUND PROFILE MEMBERS FOR DOORS OR WINDOWS

My invention relates to a coupling system of profiles for door and window frames by means of a rotating, profile connection key, between a profile and a frame.

The invention has a particular, but not exclusive application as a fixation system for wood profiles, for attaching a wooden frame or trim strip to inner aluminum window and door frames.

BACKGROUND ART

In the prior art, it is known that to secure wood and aluminum profiles using rotating, profile connection keys.

Examples of these systems have been disclosed in the documents FR,A,2516122 (ZAPP), AT,B,308361 (SOMMER) and PCT/IT90/00090 (ARCHIMEDE PROGETTI). The first two solutions reveal a profile connection key with two opposite key-shaped tapering flanges, with a central connection neck able, by means of the two opposite tapers of the flanges, to enable the coupling of profiles with a direct axial insertion (orthogonal in respect to the groove of the profile) with a successive connection by rotating 90° the same profile connection key.

The third solution provides instead, on one side, a key-shaped tapered flange and on the other a disc-shaped flange, which must be previously inserted head first inside one of the grooves of the profiles and then coupling the second profile by means of a direct orthogonal coupling and a successive rotation of 90° of the profile connection key.

These solutions, even if they, provide the possibility to couple two profiles generally inside the respective dovetail or undercut groove, have the drawback that they are free to move or slide inside the respective groove or have a slight interference, consequently:

- if there is interference on one side and free scrolling on the other, once inserted in the groove on the side of profile without interference, it is not possible to keep them in a position for the coupling with the second profile unless we make a horizontal assembly during the assembly or vertical re-assembly and then proceed to the re-spacing and fixation one at a time;
- if they have interference on both sides, then there is a difficulty in positioning for slippage.

DISCLOSURE OF INVENTION

The object of the present invention is to eliminate the above-mentioned drawbacks.

This and other objects are achieved by means of a coupling system for profiles of door and window frames, utilising a plurality of profile connection keys spaced along the profile. The profile connection keys each having a key hooking head on one side and a disc-shaped flange on the other, connected by a neck with an intermediate key shaped spacer (key to allow rotation of the entire device for keying two separate pieces), characterised in that the disc-shaped flange has a modified disc-shaped form with a resilient interference protrusion on two orthogonal crossing axes respectively, the point where they cross coinciding with the longitudinal axis of said key hooking head.

The method is characterised more particularly in that;

said disc-shaped flange is free to slide when seated inside the groove of the first profile even when the orthogonal axes are rotated in respect to the initial position, up to a maximum of 45°, It is possible, after having inserted the disc-shaped flange of the profile connection key inside said first profile and having rotated at 45° in respect to the interference axes in the first profile, to permit said profile connection key to move up and down freely inside the respective groove of the first profile. In addition, each profile connection key, once in a coupling position, is rotated 45° in order that the free protruding key hooking head is disposed longitudinally in respect to the groove of the first profile, resting there resiliently held by the interferenece protrusions, allowing insertion of the key hooking head in the second profile, and rotating each profile connection key 90°, to dispose the disc-shaped flange in a second stable interference position.

In this way we obtain the advantage to have the possibility to:

move freely the profile connection keys along the groove of the first profile, place them exactly in the position wanted, and lastly, rotate them 90° after having inserted transversely the second profile on them, for the definitive and final coupling.

With these operations, thanks to the interference system according to an angle of rotation with free slippage at an angle of rotation different if associated to the position of the connection of the second flange with the second profile, it is possible to carry out the assembly and disassembly of wood laths or strips for example for replacement, in any position, also vertically and so also on frames of doors and windows already installed vertically on the wall, without the danger and difficulty of misplacing the respective profile connection keys.

These and other advantages appear in the following preferred embodiments in conjunction with the enclosed drawings which are not to be considered limitative but only exemplary.

Figure 1:
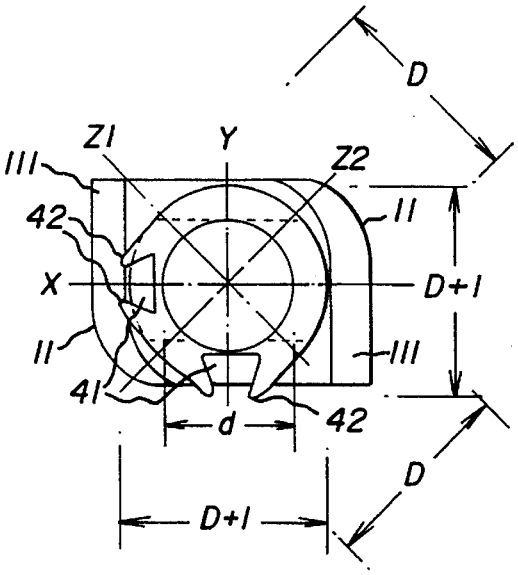
FIG. 1 is a front elevational view of a profile connection key from the side of the connecting flange on the first profile, modified disc-shaped.
Figure 2:
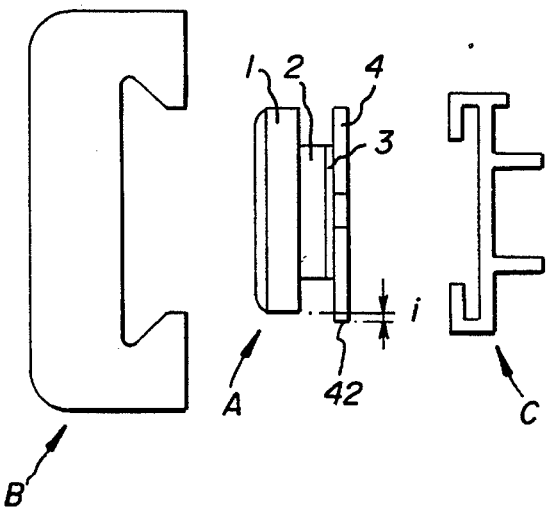
FIG. 2 is a side elevational view of the left side of the profile connection key of FIG. 1 with the respective profiles to couple respectively, the first in aluminum on the right and the second in wood on the left.

Making reference to the drawings it is disclosed that the invention consists substantially in a coupling system for profiles of door and window frames, utilising a plurality of profile connection keys (A) spaced along an aluminum profile (C), the profile connection keys (A) having opposite flanges 1 and 4 which are connected to the profiles by rotation after their insertion in the respective profile grooves. The key (A) has a rectangular key hooking head (1) on one side having its respective borders from 11–111 tapered and having a rounded corner (11) and a sharp corner (111), and a disc-shaped flange (4) on the other side, connected by a neck (3) with an intermediate key-shaped spacer (2), the disc-shaped flange (4), has a modified disc-shaped form having resilient interference protrusions (42) on two orthogonal crossing axes (X/Y) respectively, the point where they cross coinciding with the longitudinal axis of said key hooking head (1). Thus, flange 4 has free slippage, even if locked inside the groove of a first profile (C), on an orthogonal axis rotated, in respect to the previous position, up to a maximum of 45° (Z1Z2), after having inserted the disc-shaped flange (4) of the profile connection key (A) inside the said first profile (C) and rotated 45° in respect to the interference position in the first profile (Z1Z2). This enables said profile connection keys (A) to scroll or slide freely inside the respective groove of the first profile (C) and:

once in a coupling position, to be rotated 45° in order that the free protruding key hooking head (1) is disposed longitudinally with respect to the groove of the first profile (C), remaining there resiliently held by the interference protrusions, thus allowing insertion of the key hooking head in the second profile (B/B') and lastly: each profile connection key (A) is rotated 90°, to bring the disc-shaped flange (4) to rest in a second stable interference position.

Figure 3:
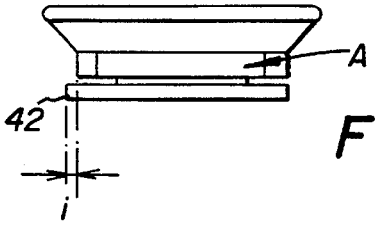
FIG. 3 is a top plan view of the profile connection key of FIG. 1.

Advantageously, the respective configurations of the connection key (A) which form the interference protrusions are made by means of hollows (41) between a pair of raised portions (42) slightly protruding to form an elastic interference (i) as seen in FIG. 3.

Figure 4:
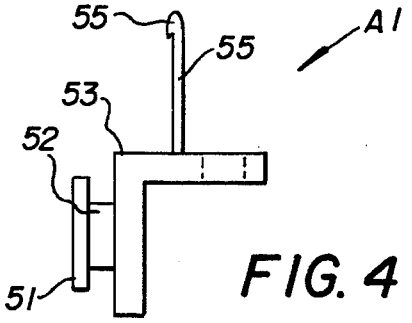
FIGS. 4, 5, 6 show respectively side, front and top views of a profile connection key with a right angle rotation for attaching of the frame to the case on the wall.
Figure 5:
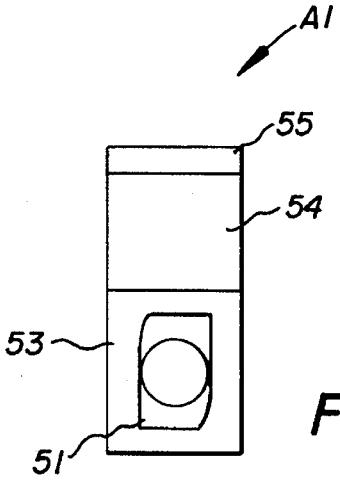
Figure 6:
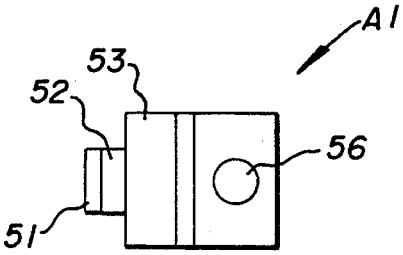
Figure 7:
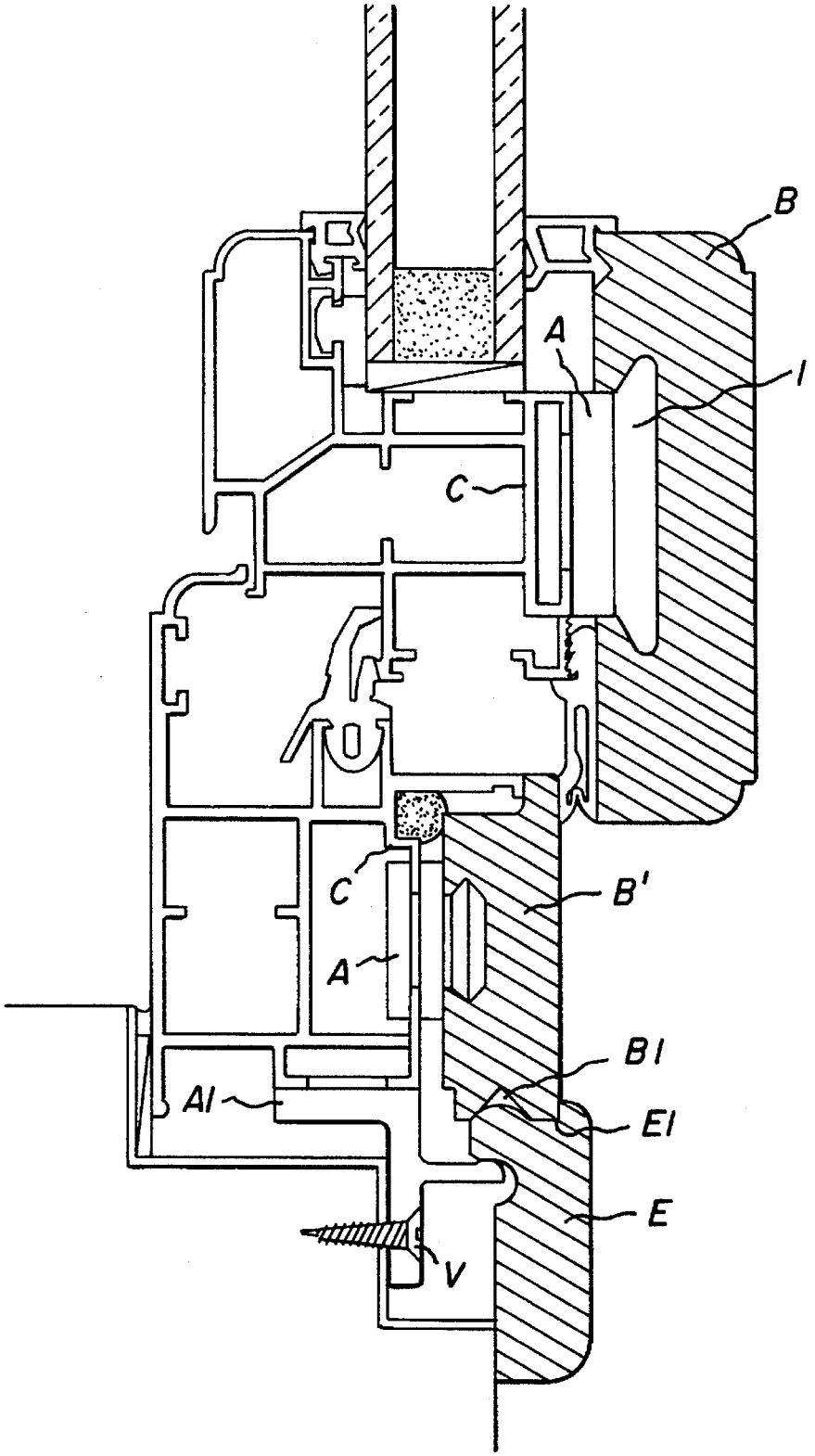
FIG. 7 represents a section of a profile of a frame assembled to form a window frame.
Figure 8:
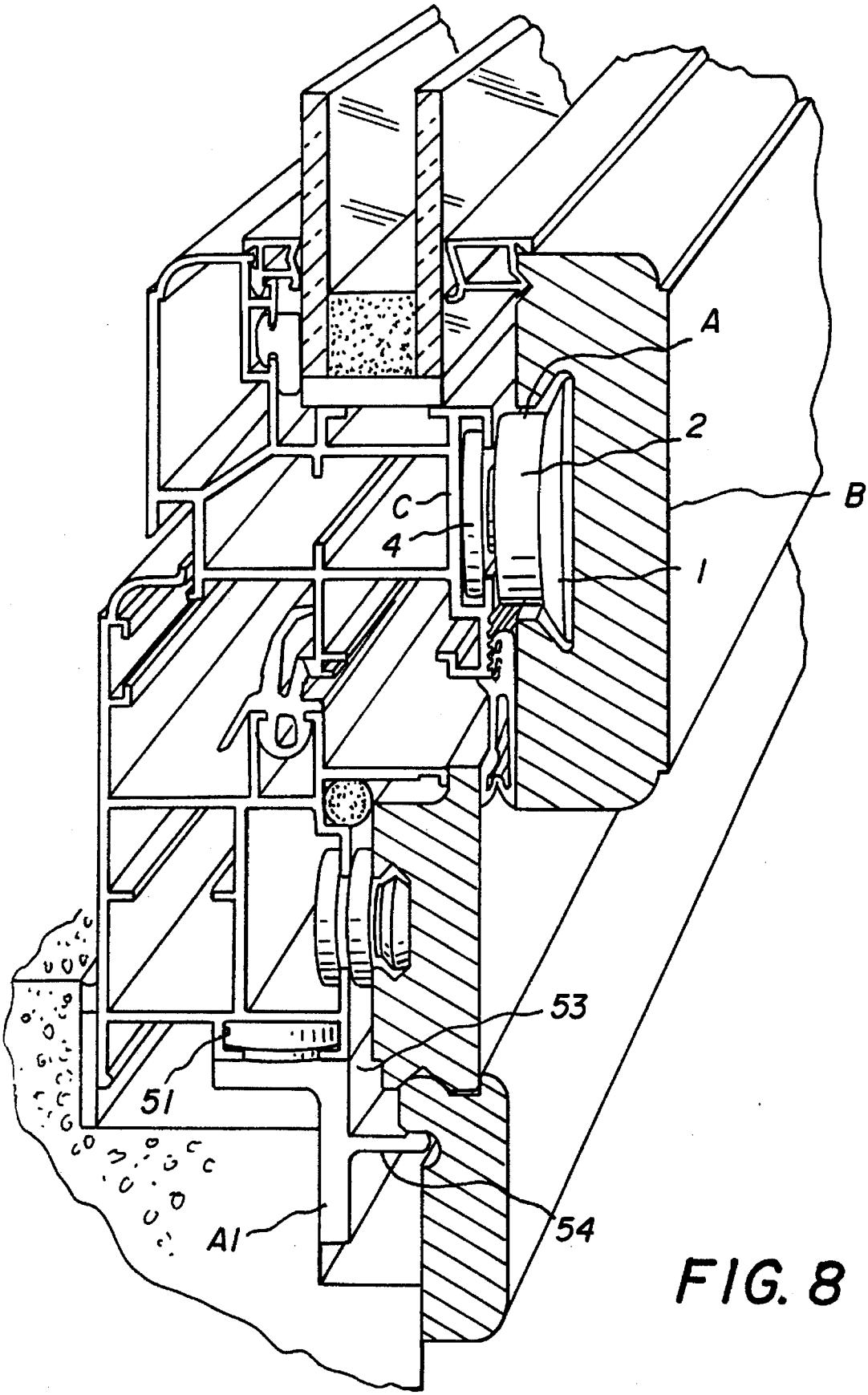
FIG. 8 is a perspective view of the ends of connected aluminum and wood profiles in a window frame of FIG. 7.

As shown in FIGS. 4–6, a door or window frame is secured to a casing on the wall by means of right-angled pieces (A1) that have on one side a rotating disc-shaped flange (51) with connection neck (52) along a profile of the frame (C) and on the other at least one hole (56) for a screw means (V) (see FIG. 7) of fixation.

In this way the positioning is easy and sure and the same right-angled piece (53) disposes of a respective resiliently yielding fin (54) with a serration (55) in order to enable the transversal automatic spring connection of a butt strap (E) in association with the coinciding groove (B1) and abutment E1 on an adjacent wood strip (B') inserted with profile connection keys (A) as before, (B).

I claim:

1. Coupling system for profiles of doors and window frames comprising a plurality of profile connection keys (A) spaced along a first profile (C), a second profile B, each of said profiles having longitudinal grooves facing each other, the profile connection keys (A) each having first and second sides and opposite flances on said sides, said flanges being connected to the profiles by rotation after their insertion in the respective profile grooves, one of said flanges comprising a substantially rectangular key hooking head having a central longitudinal axis on one side (1) and a disc-shaped flange having a periphery on the other side (4) connected by a neck (3) with an intermediate key shaped spacer (2), said disc-shaped flange (4) has a modified disc-shaped form with resilient interference protrusions (41) extending outwardly of the periphery of the disc-shaped flange on two orthogonal crossing axes (X/Y) respectively crossing at a point coinciding with the central longitudinal axis of said key hooking head (1).

2. A method of clamping a pair of profiles together with a plurality of profile connection keys (A) having the characteristics of claim 1, inserting the disc-shaped flange (4) of the profile connection key (A) inside said first profile (C) and rotating said key 45° in respect to the interference axes in the first profile (Z1-Z2) to permit said profile connection key *A) to move transversely freely inside the respective groove of the first profile (C), such that said disc-shaped flange is free to slide when seated inside the groove of the first profile (C) with the orthogonal axes (X-Y) rotated in respect to the initial position, up to a maximum of 45° (Z1-Z2)

rotating each profile connection key (A), once in a coupling position, such that the free protruding key hooking head (1) is disposed longitudinally in respect to the groove of the first profile (C), resting in a predetermined position resiliently held by the interference protrusions to allow insertion of the key hooking head in the second profile (B/B'), and rotating each profile connecting key (A) 90°, to bring the disc-shaped flange to rest in a second stable interference position.

3. A coupling system using a connection key for profiles according to claim 1, characterised in that the resilient interference protrusions of said connection key which form the interference protrusions are made by means of hollows (41) that form pairs of projections (42) slightly protruding to form a resilient interference (i).

4. A coupling system using a connection key for profiles, according to claim 1 wherein said key hooking head (1) has a rectangular shape, which has two opposed tapered keying edge, each edge beginning with a rounded corner (11) and ending with a sharp corner (111).

5. A coupling system in combination with securing door or window frame members having coupled profiles by means of profile connection keys according to claim 1, wherein a said frame member is secured to a casing on a wall by means of right-angled pieces (A1) each having first and second sides, said first side having a disc-shaped flange (51) with a connection neck (52) along a profile of the frame member of a door or window (C) and said second side having at least one hole (56) to receive a screw fastener means (V) and a protruding orthogonal resiliently yielding fin (54) with a serration (55).

* * * * *